US006525482B2

(12) United States Patent
Miyamoto

(10) Patent No.: US 6,525,482 B2
(45) Date of Patent: Feb. 25, 2003

(54) ION SOURCE AND OPERATION METHOD THEREOF

(75) Inventor: Naoki Miyamoto, Kyoto (JP)

(73) Assignee: Nissin Electric Co., Ltd., Kyoto (JP)

( * ) Notice: Subject to any disclaimer, the term of this patent is extended or adjusted under 35 U.S.C. 154(b) by 0 days.

(21) Appl. No.: 09/986,628

(22) Filed: Nov. 9, 2001

(65) Prior Publication Data

US 2002/0053880 A1 May 9, 2002

(30) Foreign Application Priority Data

| | | |
|---|---|---|
| Nov. 9, 2000 | (JP) | 2000-342057 |
| Mar. 9, 2001 | (JP) | 2001-066623 |
| Aug. 30, 2001 | (JP) | 2001-261486 |

(51) Int. Cl.[7] ..... H01J 27/02
(52) U.S. Cl. ..... 315/111.81; 250/427
(58) Field of Search ..... 250/423 R, 427; 315/111.81, 111.21

(56) References Cited

U.S. PATENT DOCUMENTS 4,869,835 A * 9/1989 Ogawa et al. ..... 250/423 R

FOREIGN PATENT DOCUMENTS

| | | |
|---|---|---|
| GB | 2360390 | 9/2001 |
| JP | 2-223144 | 9/1990 |
| JP | 6-295693 | 10/1994 |
| JP | 9-63981 | 3/1997 |
| JP | 9-161703 | 6/1997 |
| JP | 10-177846 | 6/1998 |
| JP | 110025872 | 1/1999 |
| JP | 2000090844 | 3/2000 |

OTHER PUBLICATIONS

British Patent Office Search Report dated Jul. 23, 2002.

* cited by examiner

*Primary Examiner*—David Vu
(74) *Attorney, Agent, or Firm*—Finnegan, Henderson, Farabow, Garrett & Dunner, LLP

(57) ABSTRACT

In an ion source, a rear reflector 10 is electrically insulated from both a plasma production vessel 2 and a filament 6. The rear reflector 10 and an opposed reflector 8 are electrically connected. Further, a DC bias power supply 32 is a power supply individuated from a filament power supply 24 and an arc power supply 26. The DC bias power supply 32 is placed for applying a bias voltage $V_B$ between the opposed reflector 8 and the rear reflector 10 and the plasma production vessel 2 with both the reflectors 8 and 10 as negative potential.

20 Claims, 9 Drawing Sheets

ION SOURCE AND OPERATION METHOD THEREOF

BACKGROUND OF THE INVENTION

1. Field of the Invention

This invention relates to an ion source which has a filament for emitting electrons and a reflector for reflecting the electrons and which applies a magnetic field to the inside of a plasma production vessel, and more particularly to means for improving an ion production efficiency, prolonging the life of the filament, etc.

2. Description of the Related Art

FIG. 12 shows a related art example of the ion source. This ion source is called Bernas-type ion source. An ion source of a similar structure is also disclosed, for example, in Japanese Patent Unexamined Publication No. Hei. 9-63981.

The ion source comprises a plasma production vessel 2, for example, shaped like a rectangular parallelepiped and also serving as a positive potential. Gas (containing also the case where the gas is vapor) for producing plasma 16 is introduced into the inside of the plasma production vessel 2. The plasma production vessel 2 is formed on a wall face (long-side wall) with an ion extraction slit 4 for extracting an ion beam 18. In the example, the ion beam 18 is extracted toward the rear of the plane of the figure.

A filament 6, for example, shaped like U, for emitting an electron e is placed in one side (one short-side wall side) of the plasma production vessel 2. The filament 6 and the plasma production vessel 2 are electrically insulated by an insulator 12.

An opposed reflector 8 for reflecting the electron e is placed facing the filament 6 in an opposite side of the plasma production vessel 2 (namely, the other short-side wall side facing the filament 6). The opposed reflector 8 and the plasma production vessel 2 are electrically insulated by an insulator 13. The opposed reflector 8 may be placed in a floating potential without connecting to any point. The opposed reflector 8 may be also connected to one end of the filament 6 (more particularly, the negative potential terminal of a filament power supply 24) by a conductor 28 for placing the opposed reflector 8 in filament potential as described in the above-mentioned Japanese Patent Unexamined Publication No. Hei 9-63981.

A rear reflector 10 for reflecting the electron e is placed facing the opposed reflector 8 at a place positioned behind the filament 6 in the plasma production vessel 2. Namely, the rear reflector 10 is placed between the U-shaped portion of the filament 6 and the wall face of the plasma production vessel 2 behind the U-shaped portion. The rear reflector 10 and the plasma production vessel 2 are electrically insulated by insulators 12 and 14. The rear reflector 10 has been connected to one end of the filament 6 (more particularly, the negative potential terminal of the filament power supply 24) for placing the rear reflector 10 in filament potential.

In the plasma production vessel 2, a magnetic field generator 20 placed outside the plasma production vessel 2 applies a magnetic field 22 along the axis connecting the filament 6 and the opposed reflector 8 to produce and confine the plasma 16. However, the direction of the magnetic field 22 may be opposite to that shown in the figure. The magnetic field generator 20 is, for example, an electromagnet.

DC filament voltage $V_B$ (for example, about 2 to 4 V) is applied from the DC filament power supply 24 to the filament 6 to heat the filament 6 for emitting an electron (thermoelectron) e.

From a DC arc power supply 26, arc voltage $V_A$ (for example, about 40 to 100 V) is applied between one end of the filament 6 and the plasma production vessel 2 with the filament 6 as the negative potential to produce arc discharge between the filament 6 and the plasma production vessel 2.

FIG. 13 shows an example of potential variation in the ion source according to the elated art. In the example, the opposed reflector 8 is connected to one end of the filament 6 by the conductor 28. However, if the opposed reflector 8 is not connected to any point for placing the opposed reflector 8 in floating potential, the potential of the opposed reflector 8 becomes the same extent as that in the example, namely, the same extent as the potential of the filament 6. The reason is that if the opposed reflector a is placed in the floating potential, a far larger number of light and high-mobility electrons in the plasma 16 than the number of ions are incident on the opposed reflector 8 and thus the opposed reflector 8 is charged at negative potential.

The gas introduced into the inside of the plasma production vessel 2 is ionized by the above-mentioned arc discharge to produce the plasma 16. From the plasma 16, the ion beam 18 can be extracted by an electric field. Usually, an extraction electrode for extracting the on beam 18 is placed at a point opposed to the ion extraction slit 4 (the rear of the plane of the figure), but is not shown here.

The production process of the plasma 16 will be discussed in detail. The electron e emitted from the filament 6 is accelerated toward the plasma production vessel 2 by the above-mentioned arc voltage $V_A$ (the filament voltage $V_F$ is small as mentioned above and therefore is ignored in the description). Then accelerated electron e with the energy corresponding to the voltage $V_A$ collides with a gas molecule for ionizing the gas molecule, whereby plasma 16 is produced. The ions and electrons (also containing thermoelectrons emitted from the filament 6) e in the plasma 16 are trapped by the above-mentioned magnetic field 22 and further repeat collision with gas molecules, thereby producing and confining the plasma 16.

The potential of the plasma 16 becomes a potential between the potential of the plasma production vessel 2 and the potentials of both the reflectors 8 and 10, as shown in FIG. 13, and a potential difference occurs between the plasma 16 and both the reflectors 8 and 10. The potential difference causes electrons e emitted from the filament 6 or produced in the plasma 16 to be reflected on both the reflectors 8 and 10 and reciprocate between both the reflectors 8 and 10. Consequently, the collision probability between the electrons e and gas molecules is increased and plasma 16 with a high density can be produced. As a result, the extracted ion beam 18 can be increased.

There is a demand for extracted multiply charged ions of doubly charged or more ions for use as the ions forming the ion beam 18 from the ion source as described above. The reason why there is such a demand is that a multiply charged ion can provide acceleration energy valence times that of a singly charged ion at the same acceleration voltage (for example, a doubly charged ion provides acceleration energy twice that of a singly charged ion) and thus high energy can be easily provided.

However, in the ion source in the related art as described above, production of multiply charged ions is not considered and thus the production amount of the multiply charged ions is small as compared with that of molecular ions or singly charged ions. That is, the ratio of the multiply charged ions in the plasma 16 and thus the ratio of the multiply charged ions contained in the ion beam 18 are not high. Therefore, the multiply charged ions cannot be used effectively.

SUMMARY OF THE INVENTION

An object of the present invention is to provide an ion source and operation method thereof which can improve the production efficiency of multiply charged ions in an ion source for increasing the ratio of multiply charged ions contained in an ion beam. Other objects are described later.

In order to accomplish the object above, the following means are adopted. According to the present invention, there is provided an ion source of a first aspect comprising a rear reflector, an opposed reflector, a filament, a filament power supply, a plasma production vessel, an arc power supply, and a DC bias power supply. The rear reflector is electrically insulated from the filament and the plasma production vessel. The DC bias power supply is a power supply individuated from the filament power supply and the arc power supply. The DC bias power supply is provided for applying a DC bias voltage between at least one of the opposed reflector and the rear reflector and the plasma production vessel with the reflector as a negative potential.

In the ion source, the potential of at least one of the opposed reflector and the rear reflector can be adjusted based on the bias voltage applied from the bias power supply independently of the output voltages of the arc power supply and the filament power supply. Therefore, the energy and the amount of the electrons reflected on the reflector can be adjusted according to the bias voltage. For example, the energy and the amount of the electron which reflected are increased with increasing the bias voltage.

In the ion source, it is possible to use many high-energy electrons to produce plasma and thus it is possible to more increase ionization of molecules, atoms, or ions in the plasma and produce a larger number of multiply charged ions. That is, it is possible to improve the production efficiency of multiply charged ions for increasing the ratio of the multiply charged ions contained in the ion beam.

In case of singly charged ion beam extraction, many high-energy electrons reflected on the reflector to which the bias voltage is applied can also be efficiently used to produce the plasma for enhancing the ion production efficiency, so that it is also possible to improve the singly charged ion production efficiency for increasing the extracted singly charged ion beam.

In the ion source, even if the arc voltage is reduced, the high-energy electrons reflected on the reflector to which the bias voltage is applied can ionize the gas efficiently. Thus, it is possible to prevent reducing the plasma production efficiency and to prevent a decrease in the beam current. Therefore, the filament current and further the arc current need not be made large. Consequently, it is also made possible to reduce the arc voltage for prolonging the life of the filament.

Thus, according to the ion source, if the principal object is to improve the ion production efficiency, the production efficiency of multiply charged and singly charged ions can be enhanced. If the principal object is to prolong the life of the filament, the arc voltage can also be reduced for prolonging the life of the filament. This can be accomplished in singly charged ion production and multiply charged ion production. Both improvement in the ion production efficiency and prolonging the life of the filament can also be intended.

In the ion source, at least one of the opposed reflector and the rear reflector maybe made of a material having a higher thermoelectron radiation current density than tungsten. Thus, it is possible to use also the electrons emitted from the reflector effectively to produce and confine the plasma and thus the filament current required for producing a predetermined arc current can be more reduced. Therefore, it is possible to more prolong the life of the filament.

In the ion source or an operation method thereof, the potential of at least one of the opposed reflector and the rear reflector may be made negative below the potential of the filament as the bias voltage is applied. Further, in the ion source or the operation method thereof, the bias voltage may be set larger 10 V or more than the arc voltage. Therefore, it is possible to use a larger number of high-energy electrons and thus it is possible to more enhancing the effects of improving the ion production efficiency, prolonging the life of the filament, etc., described above.

According to the present invention, there is also provided an ion source of a second aspect comprising first and second rear reflectors, first and second opposed reflectors, a filament, a filament power supply, a plasma production vessel, a arc power supply, and a DC bias power supply. The first and second rear reflectors are electrically insulated from the first and second filaments. The DC bias power supply is a power supply individuated from the filament power supply and the arc power supply. The DC bias power supply applies a DC bias voltage between at least one of the first and second rear reflectors and the plasma production vessel with the reflector as a negative potential.

In the ion source, the potential of at least one of the first and second rear reflectors can be adjusted based on the bias voltage applied from the bias power supply independently of the output voltages of the arc power supply and the filament power supply. Thus, the energy and the amount of the electrons reflected on the reflector can be adjusted according to the bias voltage. Consequently, it is possible to use many high-energy electrons to produce plasma and thus it is possible to more increase ionization of molecules, atoms, or ions in the plasma and improve the ion production efficiency.

Consequently, if the principal object is to improve the ion production efficiency, the production efficiency of multiply charged and singly charged ions can be enhanced. If the principal object is to prolong the life of the filament, the arc voltage car also be reduced for prolonging the life of the filament. This can be accomplished in singly charged ion production and multiply charged ion production. Both improvement in the ion production efficiency and prolonging the life of the filament can also be intended.

Moreover, the ion source has two pairs of filaments and rear reflectors, so that the amount of electrons emitted from each filament can be halved for still more prolonging the life of each filament.

In the ion source, at least one of the first and second rear reflectors may be made of a material having a higher thermoelectron radiation current density than tungsten. Thus, it is possible to use also the electrons emitted from the reflector effectively to produce and confine the plasma and thus the filament current required for producing a predetermined arc current can be more reduced. Therefore, it is possible to more prolong the life of the filament.

In the ion source or an operation method thereof, the potential of at least one of the first and second rear reflectors may be made negative below the potentials of the first and second filaments as the bias voltage is applied. The bias voltage may be set larger 10 V or more than the arc voltage. Therefore, it is possible to use a larger number of high-energy electrons and thus it is possible to more enhancing the effects of improving the ion production efficiency, prolonging the life of the filament, etc., described above.

In the ion source, the plasma can be ignited reliably with a large filament current at the initial condition of operating the ion source and then the filament current may be reduced. By doing this, the life of the filament can be still more prolonged.

Further, in the ion source, the magnitude of the bias voltage output from the bias power supply may be controlled. By doing this, the amount of the ion beam extracted from the ion source can be controlled at high speed as compared with the case where the filament current is changed for changing the arc current.

DETAILED DESCRIPTION OF THE INVENTION

Figure 1:
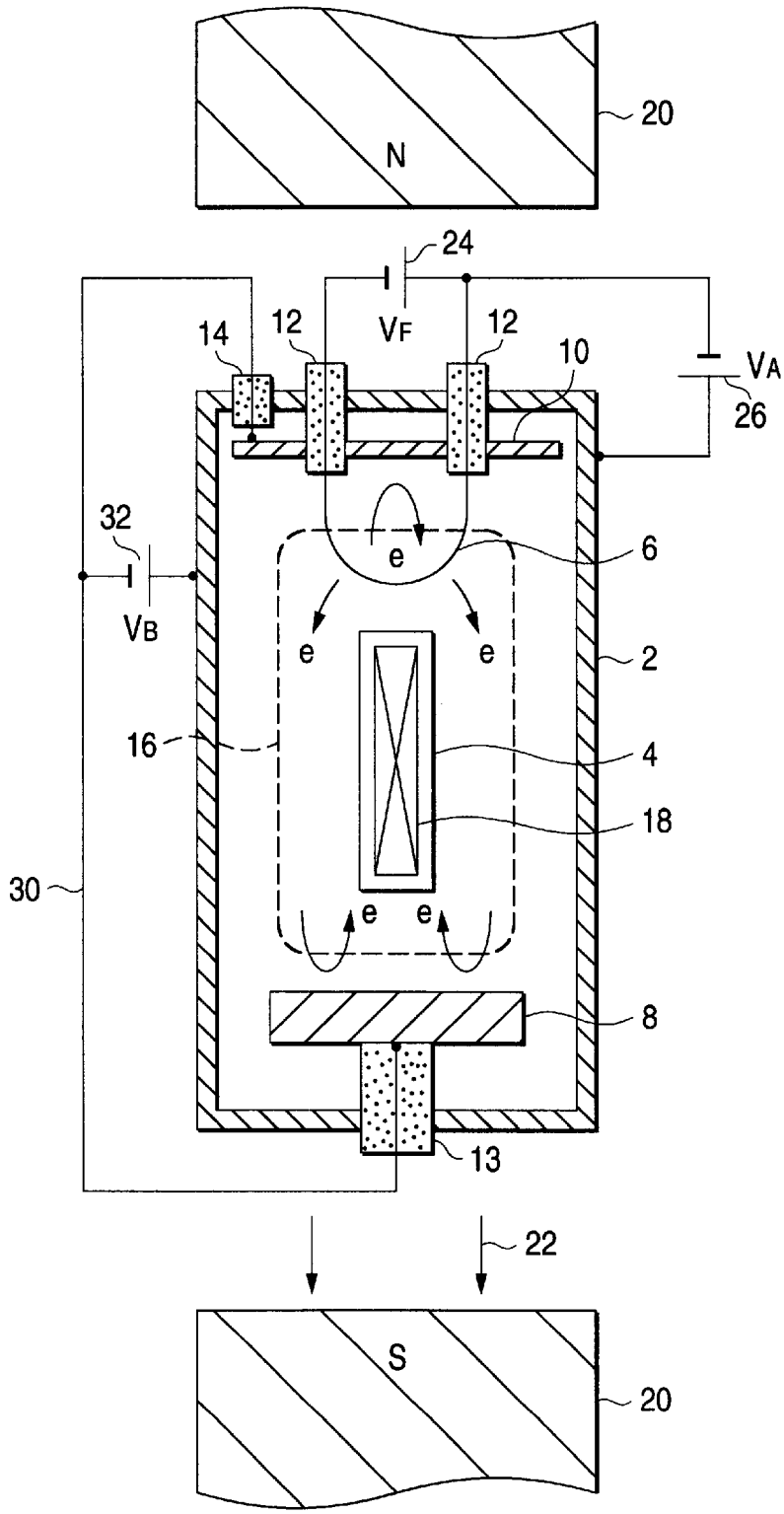
FIG. 1 is a schematic sectional view to show a first example of an ion source according to the invention.
Figure 12:
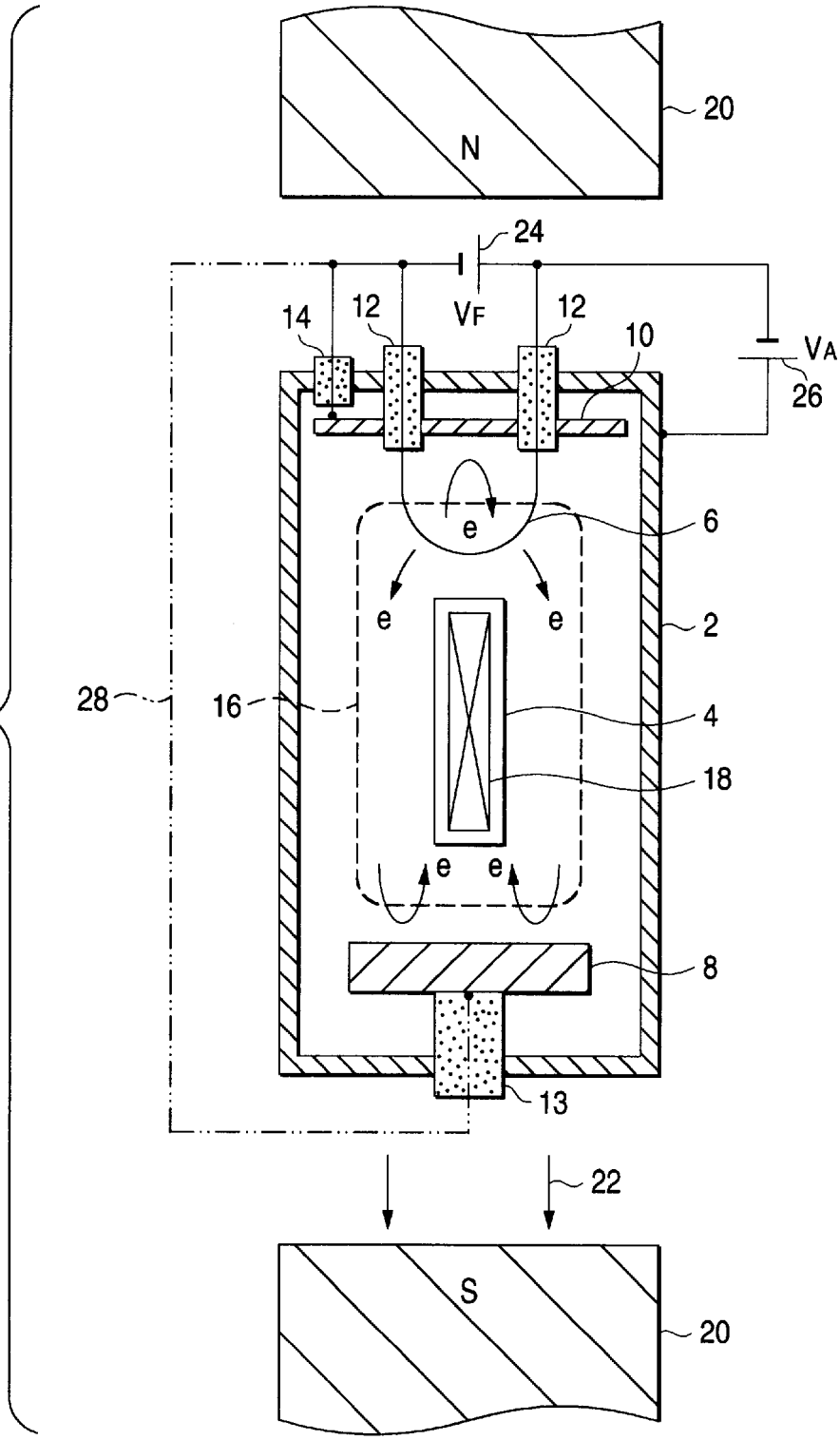
FIG. 12 is a schematic sectional view to show an example of an ion source in a related art.

FIG. 1 is a schematic sectional view to show a first example of an ion source according to the invention. Parts identical with or similar to those in the related art example previously described with reference to FIG. 12 are denoted by the same reference numerals in FIG. 1 and the differences from the related art example will be mainly discussed.

In the ion source, a rear reflector 10 is electrically insulated from a filament 6. That is, here the rear reflector 10 is electrically insulated from both a plasma production vessel 2 and the filament 6.

The rear reflector 10 and an opposed reflector 8 are electrically connected by a conductor 30 and are placed in the same potential.

Further, a DC bias power supply 32 is a power supply individuated from a filament power supply 24 and an arc power supply 26. The DC bias power supply 32 is placed for applying a DC b as voltage $V_B$ between the opposed reflector 8 and the rear reflector 10 and the plasma production vessel 2 with both the reflectors 8 and 10 as negative potential.

First, the ion source will be discussed from the viewpoint of improving the multiply charged ion production efficiency.

Figure 13:
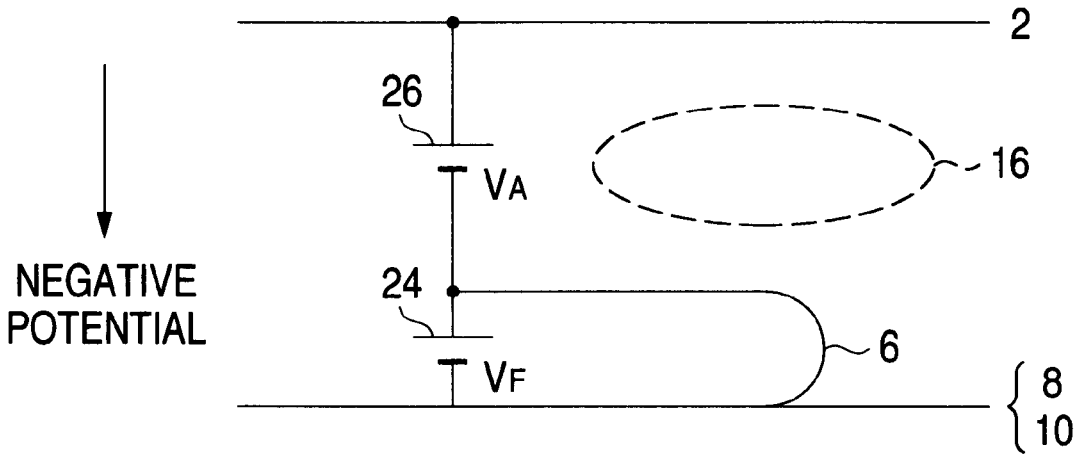
FIG. 13 is a drawing to schematically show an example of potential variation in the ion source in FIG. 12.

For comparison with the ion source, the potential variation of the ion source in the related art shown in FIG. 12 will be again discussed. As described above, in the potential variation in the related art as shown in FIG. 13, the potential of the opposed reflector 8 and the rear reflector 10 is equal to or almost equal to the potential of the filament 6. In such potential variation, reflecting of electrons e by the rear reflector 10 is not much efficient. Therefore, some of the electrons e emitted from the filament 6 collide with the rear reflector 10 placed in the proximity of the filament 6 and thus do not contribute to producing or confining the plasma 16. The rear reflector 10 has only a potential almost similar to the potential corresponding to the arc voltage $V_A$ and thus the energy of the electrons e reflected on the rear reflector 10 is not much large.

On the other hand, the opposed reflector 8 also has only a potential almost similar to the potential corresponding to the arc voltage $V_A$ and thus the energy of the electrons e reflected on the opposed reflector 8 is not much large. Reflecting of the electrons e by the opposed reflector 8 is not much efficient either. Therefore, many electrons e reflected by the opposed reflector 8 do not head for the plasma 16 and are diffused and then collide with the wall face of the plasma production vessel 2.

For this reason, in the ion source in the related art, the energy and the amount of the electrons e reflected on both reflectors 8 and 10 are small. Thus It is considered that ionization of molecules, atoms, or ions in the plasma 16 by the electrons e is not much increased and the production amount of multiply charged ions is small.

In contrast, in the ion source shown in FIG. 1, the bias power supply 32 individuated from the filament power supply 24 and the arc power supply 26 is provided. Thus based on the bias voltage $V_B$ output from the bias power supply 32, the potentials of the opposed reflector 8 and the rear reflector 10 can be adjusted independently of filament voltage V: and the arc voltage $V_A$. Therefore, the energy and the amount of the electrons e reflected on both the reflectors 8 and 10 can be adjusted according to the magnitude of the bias voltage $V_B$. For example, as the bias voltage $V_B$ is increased, the efficiency of reflecting the electrons e by both the reflectors 8 and 10 is enhanced and thus the amount of the electrons e reflected is increased. The energy of the electrons e reflected on both the reflectors 8 and 10 is also increased.

Figure 2:
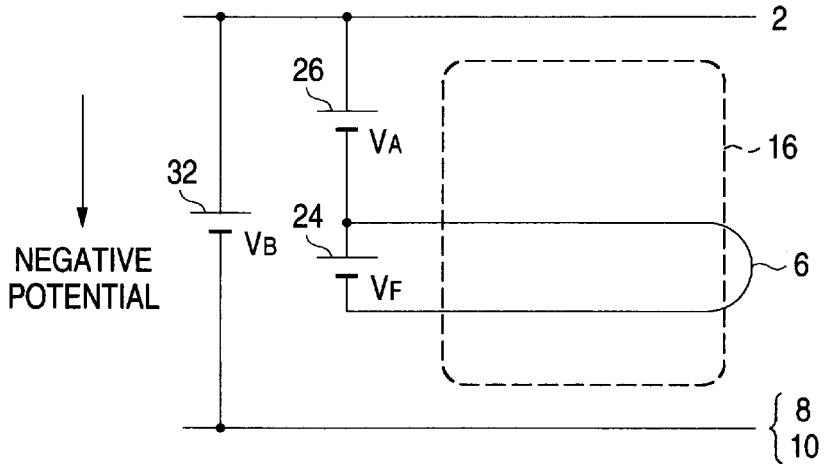
FIG. 2 is a drawing to schematically show an example of potential variation in the ion source in FIG. 1.

FIG. 2 shows an example of potential variation in the ion source according to the present invention. The potentials of the opposed reflector 8 and the rear reflector 10 can be adjusted by the bias voltage $V_B$ output from the bias power supply 32. Unlike the related art example, the potential of each of both the reflectors 8 and 10 can also be set to a negative potential below the potential of the filament 6. Therefore, as described above, the energy and the amount of the electrons e reflected on both the reflectors 8 and 10 can be made larger.

According to the ion source, it is possible to use many high-energy electrons e as mentioned above to produce and confine the plasma 16 and thus it is possible to more increase ionization of molecules, atoms, or ions in the plasma 16 and produce a larger number of multiply charged ions. That is, the production efficiency of multiply charged ions can be improved and the ratio of the multiply charged ions contained in the plasma 16 can be increased. Therefore, it is possible to use the multiply charged ions effectively.

Particularly, the potentials of both the reflectors 8 and 10 are made negative below the potential of the filament 6. Therefore, it is possible to use a larger number of higher-energy electrons e and thus it is possible to produce a larger number of multiply charged ions more efficiently.

For example, preferably the potential of each of both the reflectors 8 and 10 is made negative 10 V or more and more preferably 20 V or more below the potential of the filament 6 based on the bias voltage $V_B$, as seen from the result described later with reference to FIG. 3.

The preferred region of the bias voltage $V_B$ is defined based on the potentials of both the reflectors 8 and 10. However, the preferred region of the bias voltage $V_B$ may be defined based on the relationship with the arc voltage $V_A$. Specifically, the bias voltage $V_B$ (more accurately, the absolute value of the bias voltage $V_B$) is made larger 10 V or more than the arc voltage $V_A$ (more accurately, the absolute value of the arc voltage $V_A$). That is, the difference $\Delta V$ between the bias voltage $V_B$ and the arc voltage $V_A$ ($|V_B|-|V_A|$) may be made 10 V or more. Accordingly, it is also possible to use a larger number of higher-energy electrons e reflected on both the reflectors 8 and 10 and thus it is possible to produce a larger number of multiply charged ions more efficiently.

If an ion beam 18 of singly charged ions is extracted in case of making the arc voltage $V_A$ smaller than that to produce multiply charged ions, etc., a large number of high-energy electrons e reflected on both the reflectors 8 and 10 to which the bias voltage $V_B$ is applied can also be used efficiently to produce the plasma 16 for enhancing the ion production efficiency. Therefore, it is also possible to improve the production efficiency of singly charged ions for increasing the extraction amount of the singly charged ion beam 18. This fact is also supported by the results described later with reference to FIGS. 4 to 6.

In short, according to the ion source, the ion production efficiency can be enhanced and thus such an advantage can be used to extract a larger number of multiply charged ions and a larger number of singly charged ions.

Most preferably, the bias voltage $V_B$ from the bias power supply 32 is applied to both the opposed reflector 8 and the rear reflector 10 as in the above-described example; however, the bias voltage $V_B$ may be applied only to either the opposed reflector 8 or the rear reflector 10. In doing so, the energy and the amount of the electrons e reflected on the reflector 8 or 10 to which the bias voltage $V_B$ is applied can also be increased as described above. Thus, it is possible to improve the production efficiency of multiply charged or singly charged ions for increasing the ratio of multiply charged or singly charged ions contained in the ion beam 18. To apply the bias voltage $V_B$ to either the reflector 8 or 10, applying the bias voltage $V_B$ to the rear reflector 10 provides a larger advantage of improving the production efficiency of multiply charged or singly charged ions because of the above-described effect. However, if the bias voltage $V_B$ is applied to the opposed reflector 8, the ion source makes it possible to enhance the production efficiency of multiply charged or singly charged ions more than the ion source in the related art because of the above-described effect.

The ions in the plasma 16 are incident on and collide with the opposed reflector 8 and the rear reflector 10 to which the bias voltage $V_B$ is applied with the energy corresponding to the potential difference between the plasma 16 and both the reflectors 8 and 10 in proportion to reflecting the electrons e. Thus, the temperatures of both the reflectors 8 and 10 increase to high temperatures and therefore preferably both the reflectors 8 and 10 are made of a material having a high melting point capable of resisting the high temperatures. For example, preferably both the reflectors 8 and 10 are made of group IVA metal (Ti, Zr, Hf), group VA metal (V, Nb, Ta) or group VIA metal (Cr, Mo, W) of element periodic table or their alloy (for example, alloy of tungsten and yttrium, alloy of tungsten and zirconium, etc.,).

Next, the ion source will be discussed from the viewpoint of prolonging the life of the filament 6.

Hitherto, an art of reducing arc voltage $V_A$ and operating an ion source, namely, extracting an ion beam 18 to prolong the life of a filament 6 has been proposed (refer to Japanese Patent No. 2869558, for example). Ions (positive ions) in plasma 16 are accelerated by the arc voltage $V_A$ and collide with the filament 6. Therefore, reducing the arc voltage $V_A$ can reduce wearing of the filament 6 caused by sputtering of the ions.

However, if the arc voltage $V_A$ is simply reduced in the ion source in the related art, the acceleration energy of the electrons e emitted from the filament 6 or production in the plasma 16 by the arc voltage $V_A$ is also reduced as seen from the description given above (see FIG. 13). Thus the ionization efficiency of gas by the electrons e is reduced, the production efficiency of the plasma 16 is reduced, and the amount of the ion beam 18 (namely, beam current) that can be extracted is decreased.

An idea of increasing the filament current allowed to flow into the filament 6 from the filament power supply 24, thereby increasing the current of arc discharge between the filament 6 and the plasma production vessel 25 (namely, arc current, which is also a current flowing into the arc power supply 26) is also possible. In doing so, however, an increasing in the temperature of the filament 6 grows and the evaporation amount of the filament material increases, resulting in a new factor of shortening the life of the filament 6.

In contrast; in the ion source according to the present invention, the energy and the amount of the electrons e reflected on both the reflectors 8 and 10 can be adjusted based on the bias voltage $V_B$. As the bias voltage $V_B$ is increased, the energy and the amount of the electrons e reflected are increased, as described above. Particularly, it is possible to use a larger number of higher-energy electrons e by making the potentials of both the reflectors 8 and 10 negative below the potential of the filament 6 based on the bias voltage $V_B$. It is also possible to use the larger number of higher-energy electrons e by making the bias voltage $V_B$ applied to both the reflectors 8 and 10 larger 10 V or more than the arc voltage $V_A$, as described above. The gas in the plasma production vessel 2 can be ionized efficiently by the high-energy electrons e reflected on both the reflectors 8 and 10. Thus, even if the arc voltage $V_A$ is reduced, decreasing of the production efficiency of the plasma 16 can be prevented and a decrease in the beam current of the ion beam 18 can be prevented. Therefore, the filament current and by extension the arc current need not be made large.

This point will be discussed in more detail. To efficiently ionize the gas introduced into the plasma production vessel 2 and efficiently produce the plasma 16, it is necessary to produce many electrons e having energy more than the ionizing energy of the gas. In the related art, the energy of the electrons e is determined by the arc voltage $V_A$.

Therefore, if the arc voltage $V_A$ is made smaller than the voltage corresponding to the ionizing energy of the gas, the ionization efficiency of the gas is become small rapidly.

In contrast, for example, if the bias voltage $V_B$ larger 10 V (=ΔV) or more than the arc voltage $V_A$ is applied to both the reflectors 8 and 10 as mentioned above, the electrons e accelerated by the arc voltage $V_A$ and also the electrons e reflected on both the reflectors 8 and 10 and having energy higher than the energy corresponding to the arc voltage $V_A$ can be used to ionize gas Accordingly, the energy distribution of the electrons e can be shifted higher as much as ΔV than that when only the arc voltage $V_A$ is used. Moreover, the electrons e having energy corresponding to the arc voltage $V_A$ and the electrons e having energy corresponding to the bias voltage $V_B$ are mixed and thus the width of energy in the vicinity of the peak in the energy distribution of the electrons e is also widened. Therefore, if the arc voltage $V_A$ is small, the energy of the electrons e used to ionize gas can be much distributed in the vicinity of the energy value fitted for ionizing the gas. Thus, even if the arc voltage $V_A$ is small, the gas can be ionized efficiently and a decrease in the beam current can be prevented.

Moreover, the wearing of the filament 6 caused by sputtering of the ions in the plasma 16 depends on the arc voltage $V_A$ as described above, but not on the bias voltage $V_B$. This means that if the bias voltage $V_B$ is increased, the wearing of the filament 6 is not grown. That is why both the reflectors 8 and 10 reflect the electrons e and do not produce the effect of accelerating the ions sputtering the filament 6.

Therefore, even if the arc voltage $V_A$ is small, a decrease in the beam current can be prevented without increasing the arc current because of increasing the bias voltage $V_B$. Consequently, it is possible to reduce the arc voltage $V_A$ for prolonging the life of the filament 6.

To more reduce the arc voltage $V_A$ for more prolonging the life of the filament 6, etc., the difference ΔV between the bias voltage $V_B$ and the arc voltage $V_A$ may be made larger than 10 V described above. For example, as seen from a specific embodiment described later, if the bias voltage $V_B$ is larger 20 V or more than the arc voltage $V_A$, a more remarkable effect of preventing a decrease in the beam current is exerted. From the viewpoint of making the potentials of both the reflectors 8 and 10 negative below the potential of the filament 6 based on the bias voltage $V_B$, for example, preferably the potentials are made negative 10 or more below the potential of the filament 6 and more preferably 20 V or more.

To prolong the life of the filament 6, most preferably, the bias voltage $V_B$ from the bias power supply 32 is applied to both the opposed reflector 8 and the rear reflector 10 as in the above-described example; however, the bias voltage $V_B$ may be applied only to either the opposed reflector 8 or the rear reflector 10. In doing so, the energy and the amount of the electrons e reflected on the reflector 8 or 10 to which the bias voltage $V_B$ is applied can also be increased as described above and accordingly the ion production efficiency can be enhanced.

Prolonging the life of the filament 6 is not limited to the case where singly charged ions are extracted as the ions making up the ion beam 18, and is also possible when multiply charged ions such as doubly charged ions as described above are extracted. To produce multiply charged ions, generally the arc voltage $V_A$ needs to be increased as compared with the case where singly charged ions are extracted. However, the bias voltage $V_B$ as described above is applied, it is possible to extract multiply charged ions even if the arc voltage $V_A$ is smaller as described above, and thus it is also made possible to prolong the life of the filament 6.

In short, according to he ion source, if the principal object is to improve the ion production efficiency, the production efficiency of multiply charged and singly charged ions can be enhanced. If the principal object is to prolong the life of the filament 6, the arc voltage $V_A$ can also be reduced for prolonging the life of the filament 6. This can be accomplished in singly charged ion production and multiply charged ion production. Both improvement in the ion production efficiency and prolonging the life of the filament 6 can also be possible. To do this, the arc voltage $V_A$ may be reduced less than that if the principal object is to prolong the life of the filament 6.

Next, a more specific example for improving the production efficiency of multiply charged ions will be discussed.

Figure 3:
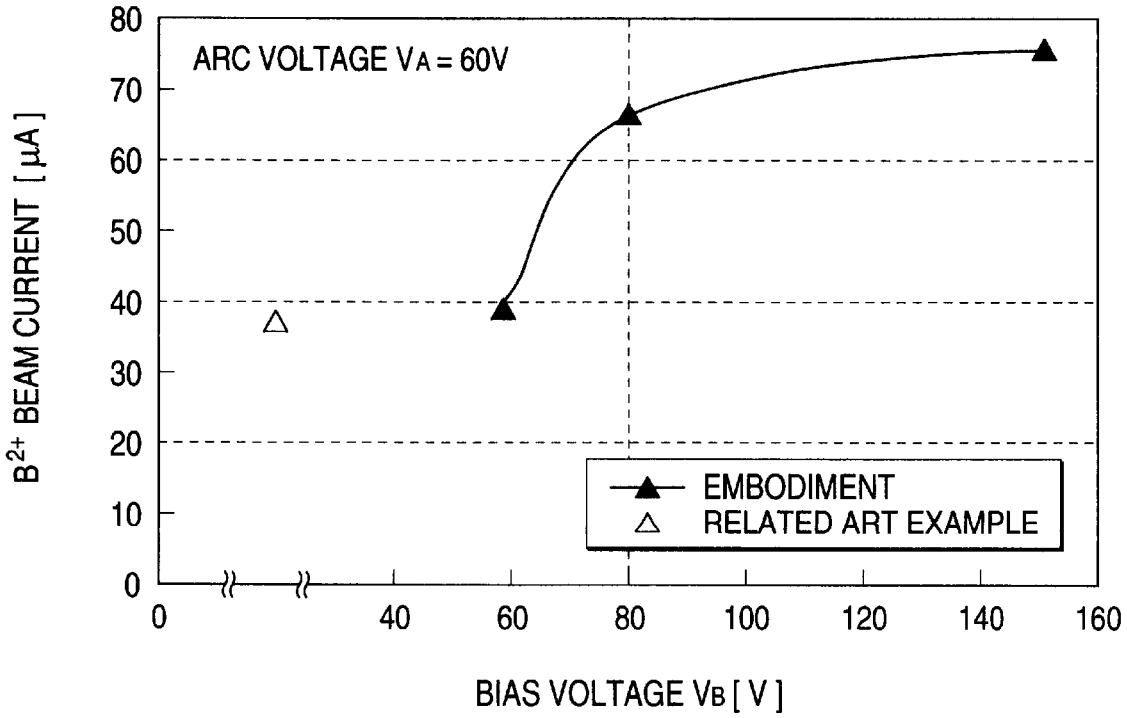
FIG. 3 is a drawing to show an example of the bias voltage characteristic of doubly charged ion beam current of boron.

FIG. 3 shows as embodiment the experimental result of the situation in which the beam current of doubly charged ions of boron ($B^{2+}$) contained in a boron ion beam as the ion beam 18 changes depending on the bias voltage $V_B$ when boron tri-fluorine ($BF_3$) gas is introduced into the inside of the plasma production vessel 2 using the ion source shown in FIG. 1 and the boron ion beam is extracted as the ion beam 18. At this time, the arc voltage $V_A$ is set to 60 V and the filament voltage $V_F$ is set to about 2 V.

FIG. 3 also shows as related art example the experimental result of $B^{2+}$ beam current when the opposed reflector 8 is placed in floating potential (namely, the conductor 28 is not connected) in the ion source in the related art, previously described with reference to FIG. 12 under the same condition. In the related art example, the bias voltage $V_B$ is not applied and thus the value on the horizontal axis of measurement point is not shown (cannot be shown).

In the embodiment, when the bias voltage $V_B$ exceeds 60 V, the $B^{2+}$ beam current increases rapidly. When the bias voltage $V_B$ is 70 V or more, a clear difference from that in the related art example is seen. When the bias voltage $V_B$ is 80 V or more, a remarkable difference from that in the related art example is seen. That is, in the embodiment, since the arc voltage $V_A$ is 60 V, the potential of the filament 6 is about −60 V with the potential of the plasma production vessel 2 as the reference. When the potentials of both the reflectors 8 and 10 are made negative below −60 V based on the bias voltage $V_B$, it is possible to provide the effect of increasing the $B^{2+}$ beam current. More particularly, to extract the $B^{2+}$ beam current, preferably the bias voltage $V_B$ is 70 V or more and more preferably the bias voltage $V_B$ is 80 V or more. In other words, preferably, the potentials of both the reflectors 8 and 10 are made negative 10 V or more below the potential of the filament 6 based on the bias voltage $V_B$. More preferably the potentials are made negative 20 V or more below the potential of the filament 6. In doing so, the $B^{2+}$ beam current about 1.5 times to twice that in the related art example can be provided.

As seen in FIG. 3, when the bias voltage $V_B$ approaches 160 V, an increase in the $B^{2+}$ beam current is saturated. If the bias voltage $V_B$ is made too large, i- becomes hard to electrically insulate both the reflectors 8 and 10 and thus the upper limit of the bias voltage $V_B$ is determined naturally from the point of the electric insulation.

In FIG. 3, the reason why there is no measurement point when the bias voltage $V_B$ is smaller than 60 V is that if the bias voltage $V_B$ is set smaller than 60 V, a large load current flows into the bias power supply 32 and it becomes difficult to measure the $B^{2+}$ beam current. It is considered that the Potential of the plasma 16 is in the vicinity of −60 V under the above-mentioned condition and if the bias voltage $V_B$ is set smaller than 60 V, both the reflectors 8 and 10 pull in the electrons e rather than reflect the electrons e.

The embodiment applies to the doubly charged ions of boron, but the invention can also be used to produce and extract multiply charged ions other than the doubly charged ions of boron, of course. For example, it can also be used to produce, etc., multiply charged ions of phosphorus (P).

Next, a more specific embodiment for making it possible to prolong the life of the filament 6 will be discussed.

Figure 4:
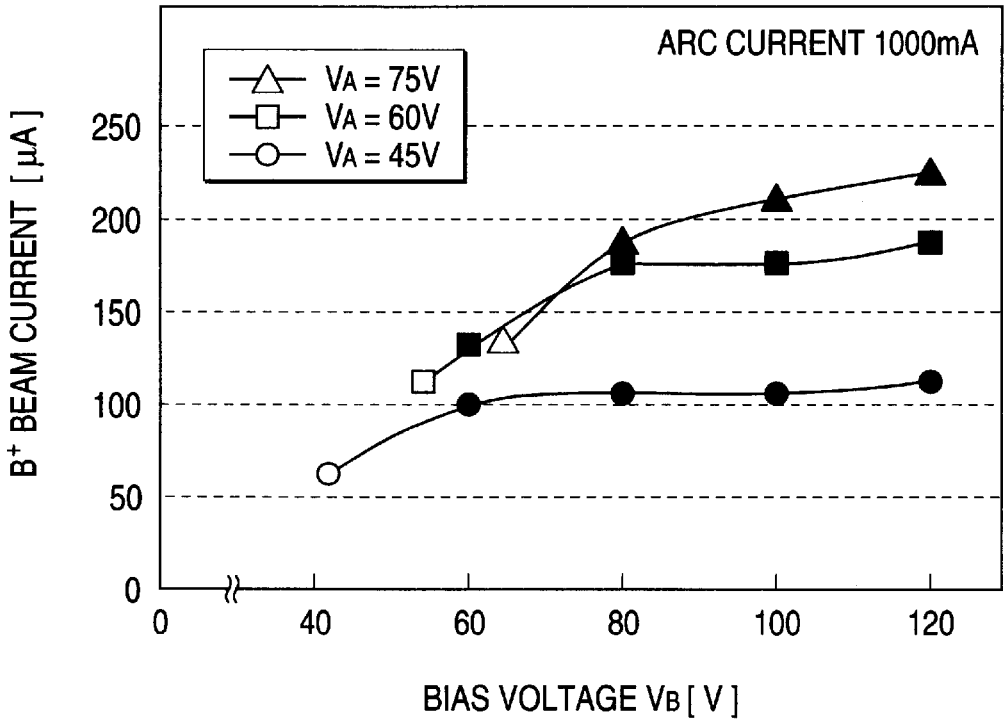
FIG. 4 is a drawing to show an example of the bias voltage characteristic of singly charged ion beam current of boron when arc current is 1000 mA.
Figure 5:
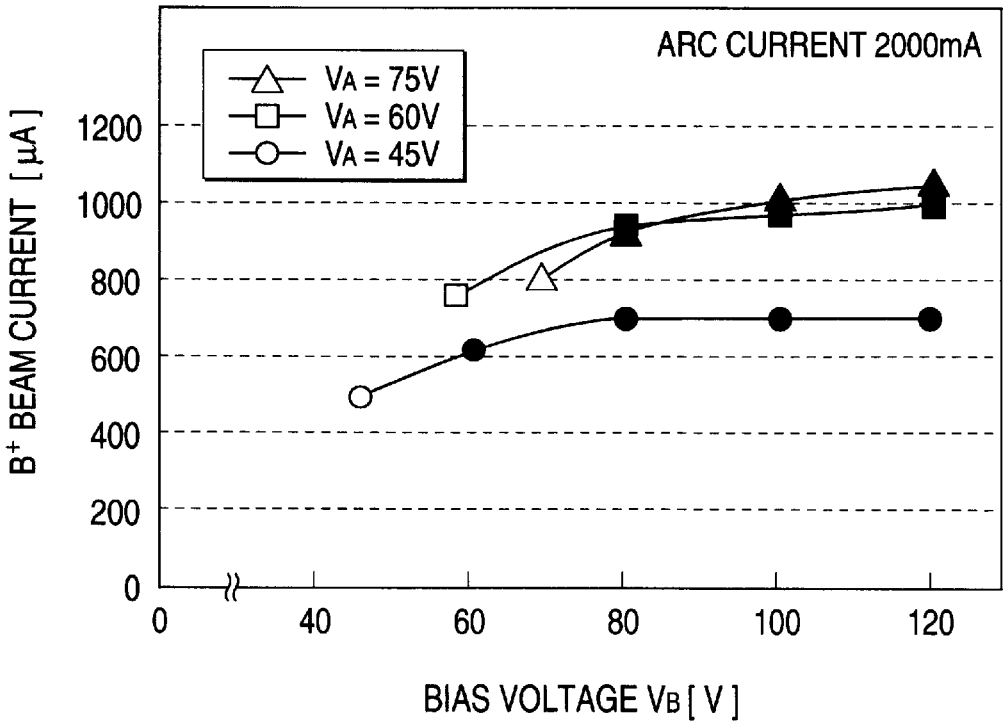
FIG. 5 is a drawing to show an example of the bias voltage characteristic of singly charged ion beam current of boron when arc current is 2000 mA.
Figure 6:
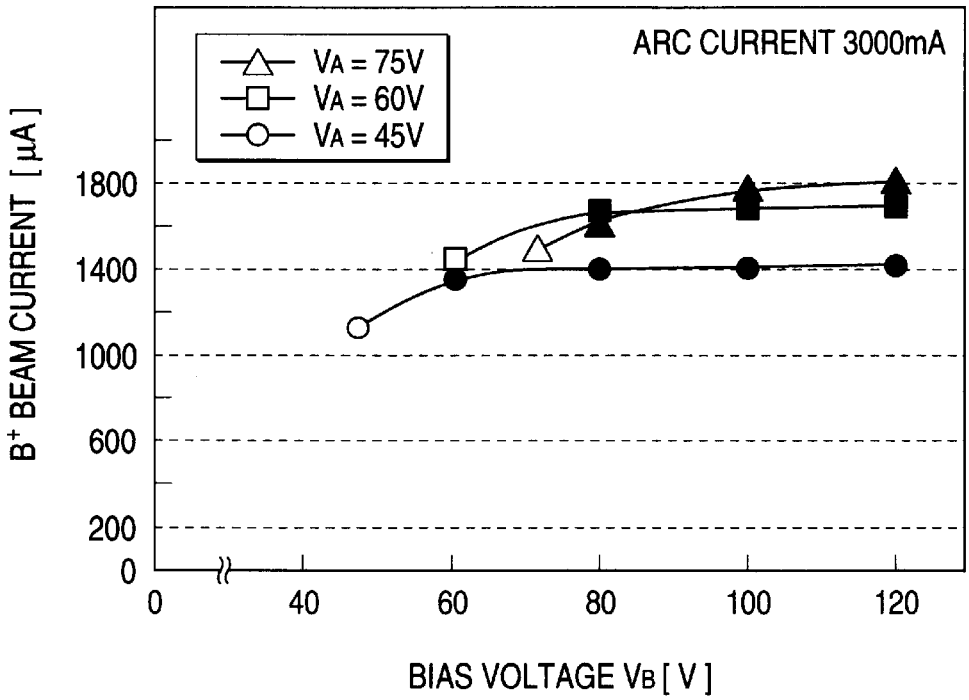
FIG. 6 is a drawing to show an example of the bias voltage characteristic of singly charged ion beam current of boron when arc current is 3000 mA.

FIGS. 4 to 6 show the experimental result of the situation in which the beam current of singly charged ions of boron ($B^1$) contained in a boron ion beam as the ion beam 18 changes depending on the bias voltage $V_B$ when boron tri-fluorine ($BF_3$) gas is introduced into the inside of the plasma production vessel 2 as in the above-described embodiment using the ion source shown n FIG. 1 and the boron ion beam is extracted as the ion beam 18. At this time, the arc voltages $V_A$ are set to 45 V, 60 V, and 75 V and the filament voltage $V_F$ is set to about 2 V. FIG. 4 shows the result when the arc current is 1000 mA, FIG. 5 shows the result when the arc current is 2000 mA, and FIG. 6 shows the result when the arc current is 3000 mA.

In each figure, the measurement point when the bias voltage $V_B$ is the lowest with each arc voltage $V_A$ (namely, hollow measurement point) in the case where the bias voltage $V_B$ is not applied, namely, both the reflectors 8 and 10 are placed in a floating potential. In this case, the reason why the potentials of both the reflectors 8 and 10 become potentials slightly smaller than the potential of the arc voltage $V_A$, namely, become the potentials corresponding to the bias voltage $V_B$ in the figure is as described above.

In FIG. 4, if the arc voltage $V_A$ is 60 V and the bias voltage $V_B$ is not applied, about 110 $\mu$A is provided as the beam current. In contrast, if the arc voltage $V_A$ is 45 V and the bias voltage $V_B$ is not applied, only about 60 $\mu$A can be provided as the beam current. The beam current is drastically decreased. However, as the bias voltage $V_B$ larger than the arc voltage $V_A$ is applied and is increased, the bean current is increased and if the bias voltage $V_B$ is made larger 10 V or more than the arc voltage $V_A$ (if the bias voltage $V_B$ is set to 55 V or more), the beam current clearly is increased. If the bias voltage $V_B$ is made larger 20 V or more than the arc voltage $V_A$, the beam current is increased remarkably as compared with the time when the bias voltage $V_B$ is not applied.

Specifically, although the arc voltage $V_A$ is reduced to 45 V, if the bias voltage $V_B$ is set to 60 to 65 V, the beam current can be provided at almost the same extent as it is provided when the arc voltage $V_A$ is 60 V and the bias voltage $V_B$ is not applied. That is, a decrease in the beam current can be prevented sufficiently, Likewise, if the arc voltage $V_A$ is reduced to 60 V, the bias voltage $V_B$ is made larger 10 V or more than the arc voltage $V_A$ (the bias voltage $V_B$ is set to 70 V or more), whereby the beam current can be provided at the same or more extent as it is provided when the arc voltage $V_A$ is 75 V and the bias voltage $V_B$ is not applied.

If the arc current is increased for increasing the whole beam current as in FIGS. 5 and 6, the bias voltage $V_B$ is made larger 10 V or more than the arc·voltage $V_A$, more preferably 20 V or more, whereby the beam current is clearly increased as compared with the time when the bias voltage $V_B$ is not applied. That is, by increasing the bias voltage $V_B$, even it the arc voltage $V_A$ is reduced to 45 V, a decrease in the beam current can be prevented and the beam current can be made to approach the beam current when the arc voltage $V_A$ is 60 V and the bias voltage $V_B$ is not applied. Likewise, if the arc voltage $V_A$ is reduced to 60 V, the beam current can be provided at the same or more extent as it is provided when the arc voltage $V_A$ is 75 V and the bias voltage $V_B$ is not applied.

As seen from the experimental results previously described with reference to FIGS 4 to 6, if the difference $\Delta V$ between the bias voltage $V_B$ and the arc voltage $V_A$ is made large to some extent, an increase in the beam current is saturated and thus the upper limit of the difference $\Delta V$ can be considered to be about 80 V. The practical upper limit of the bias voltage $V_B$ itself is about 160 V for a similar reason to that described above.

Figure 7:
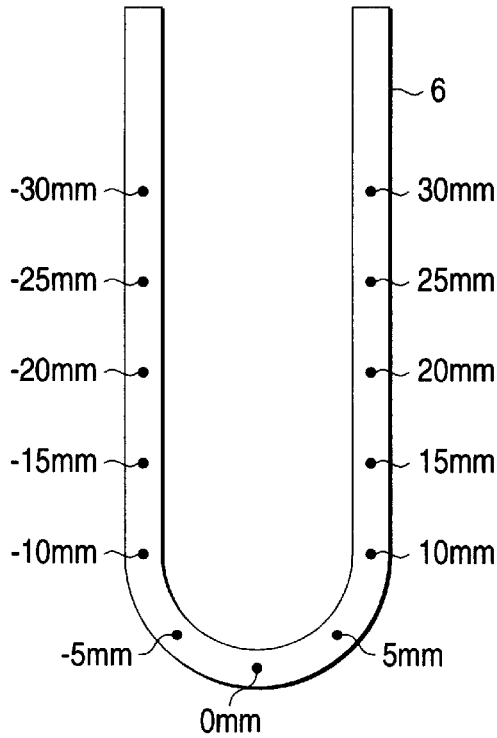
FIG. 7 is an enlarged drawing of a filament in FIG. 1.
Figure 8:
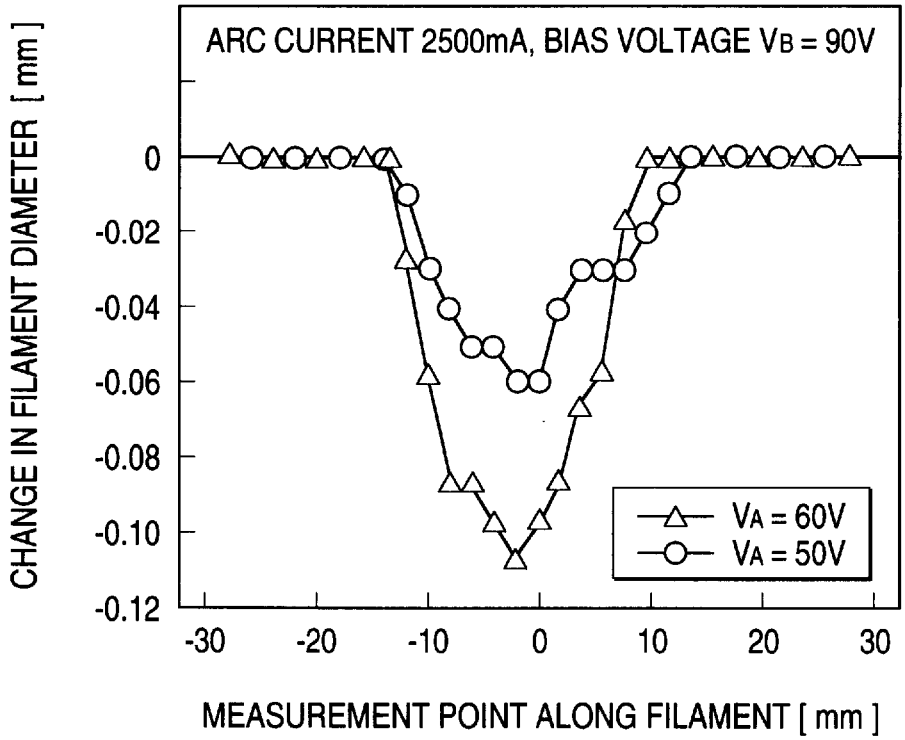
FIG. 8 is a drawing to show the experimental result of change in the diameter of the filament in FIG. 7 after 10-hour operation.

Next, FIG. 8 shows the experimental result of the wear state of the filament 6 (namely, the decrease amount of the diameter of the filament 6) after the plasma 16 is produced continuously for 10 hours when the arc voltages $V_A$ are 50 V and 60 V and the arc current is 2500 mA using argon (Ar) gas as plasma production gas in the ion source shown in FIG. 1. At this time, the bias voltage $V_B$ is set to 90 V. FIG. 7 shows the diameter measurement points of the filament 6, corresponding to the horizontal axis of FIG. 8.

As seen in FIG. 8, if the arc voltage $V_A$ is reduced from 60 V to 50 V, the wear of the filament 6 is decreased drastically. Specifically, the diameter decrease amount in the vicinity of the tip of the filament 6 is decreased near to a half. Therefore, the life of the filament 6 is prolonged drastically. This is an example wherein the arc voltage $V_A$ is reduced 10 V from 60 V to 50 V; it can be easily estimated from the result that if the arc voltage $V_A$ is reduced more than 10 V, the life of the filament 6 is more prolonged.

According to the ion source according to the invention, as described above, as the ion production efficiency is improved, the filament current required for generating a predetermined arc current can also be reduced. Accordingly the temperature of the filament 6 can be decreased and the rate of evaporation of the component material from the filament 6 can be reduced, so that the life of the filament 6 can also be prolonged.

Figure 9:
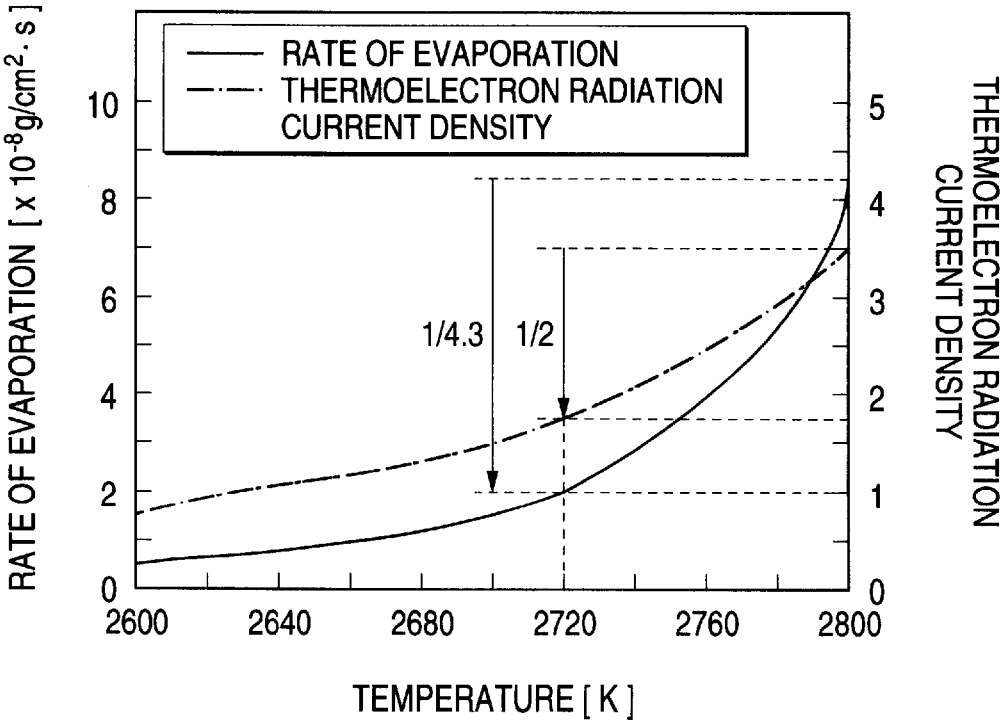
FIG. 9 is a drawing to show the temperature characteristic of the rate of evaporation of tungsten and thermoelectron radiation current density.

This point will be discussed in detail. FIG. 9 shows the temperature characteristic of the rate of evaporation of tungsten generally used as material of the filament 6 and thermoelectron radiation current density. For example, the temperature for halving the thermoelectron radiation current density at filament temperature 2800 K close to the normal operation temperature is 2720 K. In this case, the rate of evaporation of tungsten becomes about a quarter (accurately, 1/4.3) and the life of the filament 6 is prolonged close to four times. That is, if the temperature of the filament 6 is decreased from about 2800 K to about 2720 K, the thermoelectron radiation current density is reduced to about a half, but the decrease in the beam current at the time can be prevented by applying the bias current $V_B$ described above, and moreover the life of the filament 6 is prolonged about four times.

As the ions from the plasma 16 are incident on and collide with the opposed reflector 8 and the rear reflector 10, the temperatures of the opposed reflector 8 and the rear reflector 10 increase to high temperatures as described above and therefore at least one of, preferably both of the opposed reflector 8 and the rear reflector 10 may be made of a material having a higher thermoelectron radiation current density than tungsten of general component material of the filament 6. In doing so, it is possible to use also the electrons emitted from either or both of the reflectors 8 and 10 effectively to produce and confine the plasma 16. Thus the filament current required for producing a predetermined arc current can be more reduced and accordingly the life of the filament 6 can be more prolonged.

As the material having a higher thermoelectron radiation current density than tungsten (about $8.7\times10^{-1}$), for example, tantalum (about $9.9\times10^{-3}$), molybdenum (about $7.7\times10^{-3}$), niobium (about $1.2\times10^{-2}$), zirconium (about $5.5\times10^{-2}$), alloy of tungsten and yttrium (about 4.4), alloy of tungsten and zirconium (about 0.24), etc., can be used. Each numeric value enclosed in parentheses indicates the thermoelectron radiation current density of the material at 2000 K (in units of $A/cm^2$). The reason why tungsten is used as the reference is that tungsten is a general thermoelectron emission material. Among the materials, tantalum is one of preferred materials because it has a high meltingpoint (about 3250 K) and a large thermoelectron radiation current density and moreover is comparatively inexpensive.

As described above, according to the ion source according to the invention, as the ion production efficiency is improved, the filament current can be reduced and thus an operation method of relatively enlarging the filament current at the initial condition of operating the ion source and then relatively reducing the filament current may be adopted. In doing so, the plasma 16 can be ignited reliably with large filament current at the initial condition of operating the ion source and then the filament current is reduced, whereby the life of the filament 6 can be still more prolonged.

If a material having a higher thermoelectron radiation current density than tungsten as mentioned above is used as at least one of, preferably both of the opposed reflector 8 and the rear reflector 10, it is possible to use also the electrons emitted from either or both of the reflectors 8 and 10 effectively to produce and confine the plasma 16 as described above. Thus it is possible to still more reduce the filament current after the ion source operation is started for still more prolonging the life of the filament 6.

To use a material having a higher thermoelectron radiation current density as mentioned above, particularly to use the material as both the reflectors 8 and 10, the plasma 16 may be able to be maintained by emitting electrons from either or both of the reflectors 8 and 10 after the plasma 16 is ignited. In this case, the filament current can be allowed to flow only at the initial condition of operating the ion source for heating the filament 6 and then the filament current can be turned off (namely, zero). In doing so, the life of the filament 6 can be extremely prolonged.

Next, an embodiment for controlling the bias voltage $V_B$, thereby controlling the amount of the ion beam 18 will be discussed.

For example, to perform ion implantation processing, to change the ion dose, one of implantation conditions, generally the amount of an ion beam extracted prom an ion source (namely, ion beam current) is changed.

In the ion source in the related art as shown in FIG. 12, the amount o the ion beam. 18 extracted from the ion source is adjusted by changing the filament current allowed to flow into the filament 6 from the filament power supply 24 and changing the arc current.

The arc current at this time is determined mainly by the amount of thermoelectrons e emitted from the filament 6, namely, the temperature of the filament 6, but a long time becomes necessary for changing the temperature of the filament 6 installed in a vacuum (vacuum in the plasma production vessel 2 and its surroundings). That is, a long time (for example, about several ten seconds) is required for changing the arc current and the ion beam current. Consequently, for example, it takes a long time in changing the implantation conditions in ion implantation processing using the ion source, and the whole processing is delayed.

In contrast, in the ion source according to the present invention, as seen from the description previously made with reference to FIGS. 4 to 6, the amount of the ion beam 18 extracted from the ion source (namely, ion beam current) can be controlled by controlling (adjusting) the magnitude of the bias voltage $V_B$ without changing the arc current (namely, even with the same arc current).

For example, if the arc voltage $V_A$ is 60 V and the bias voltage $V_B$ is not applied in FIG. 4 (the arc current is constant (1000 mA)), about 110 $\mu$A can be provided as the beam current. In contrast, if the bias voltage $V_B$ is applied and is increased, the beam current is gradually grown and if the bias voltage $V_B$ is increased to 120 V, the beam current increases to about 190 $\mu$A.

When the arc voltage $V_A$ is not 60 V and the arc current is 2000 mA (FIG. 5) or 3000 mA (FIG. 6), likewise, it is seen that the magnitude of the beam current can be controlled by controlling the bias voltage $V_B$ even if the arc current is made constant. The same is also applied if the ion beam 18 of doubly charged ions is extracted (see FIG. 3).

Moreover, in this case, the time required for changing the beam current is determined by the time required for adjusting the bias voltage $V_B$ output from the bias power supply 32; for example, it is about several seconds. That is, the beam current can be changed at speed about 10 times as high as that if the arc current changing method in the related art described above is used (about several ten seconds). Thus, the magnitude of the bias voltage $V_B$ output from the bias power supply 32 is controlled (also containing turning on and off the bias voltage $V_B$), whereby the amount of the ion beam 18 extracted from the ion source can be controlled at high speed.

Next, a second embodiment of an ion source according to the invention will be discussed. The ion source of the second embodiment has another pair of filament 6 and rear reflector 10 in place of the above-described opposed reflector 8.

Figure 10:
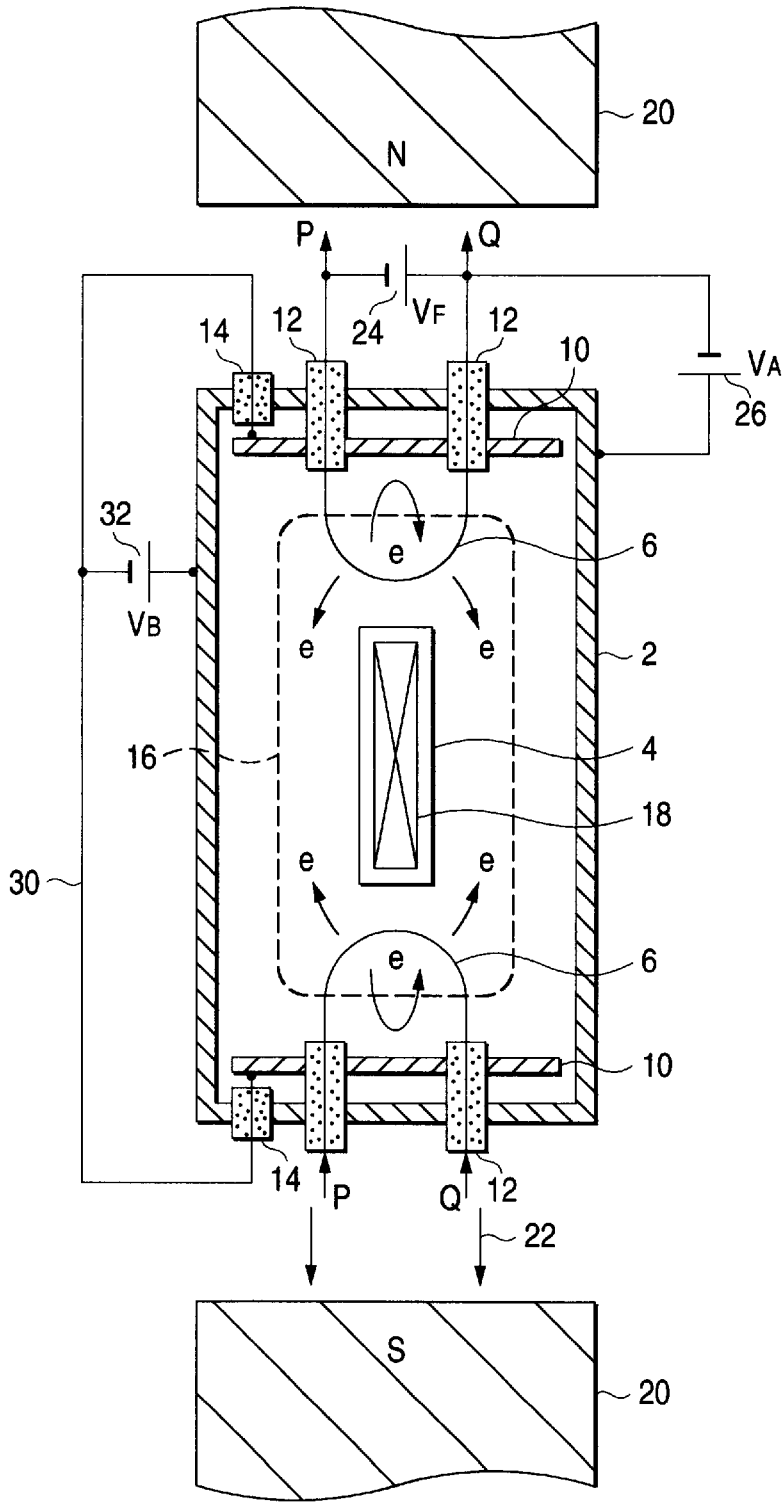
FIG. 10 is a schematic sectional view to show a second example of an ion source according to the invention.

FIG. 10 is a schematic sectional view to show the second example of the ion source according to the invention. The differences from the ion source shown in FIG. 1 will be mainly discussed. The description of the ion source in FIG. 1 is applied to other points.

In addition to one pair (first pair) of filament 6 and rear reflector 10 shown in FIG. 1, the ion source in FIG. 10 includes another pair (second pair) of filament 6 and rear reflector 10 in place of the above-described opposed reflector 8. That is, two (first and second) filaments 6 are placed facing each other in a plasma production vessel 12. Behind the filaments 6, two (first and second) rear reflectors 10 are placed facing each other.

In the second embodiment, the two filaments 6 are connected in parallel to each other at points P and Q. Therefore, from a common filament power supply 24, filament voltage $V_B$ for heating is applied to the two filaments 6. From a common arc power supply 26, arc voltage $V_A$ for arc discharge is applied to the two filaments 6. Each filament 6 may be provided with an individual filament power supply 24 and an individual arc power supply 26.

The ion source having two pairs of filaments 6 and rear reflectors 10 as described above is also described in the above-mentioned Japanese Patent Unexamined Publication No. Hei. 9-63981. In the related art, however, each rear reflector 10 is connected to one end of the corresponding filament 6 (more particularly, the negative potential terminal of the filament power supply 24) for placing the rear reflector 10 in filament potential as in the related art example in FIG. 12.

In contrast, in ion source according to the second embodiment of the present invention, each rear reflector 10 is electrically insulated from both the filament 6 and the plasma production vessel 2 as in the embodiment in FIG. 1. In the embodiment in FIG. 10, both the rear reflectors 10 are electrically connected by a conductor 33 so that they are placed in the same potential.

Further, a DC bias power supply 32 is placed for applying a DC bias voltage $V_B$ between both the reflectors 10 and the plasma production vessel 2 will both the reflectors 10 as negative potential. The DC bias power supply 32 is a power supply individuated from the filament power supply 24 and the arc power supply 26.

Figure 11:
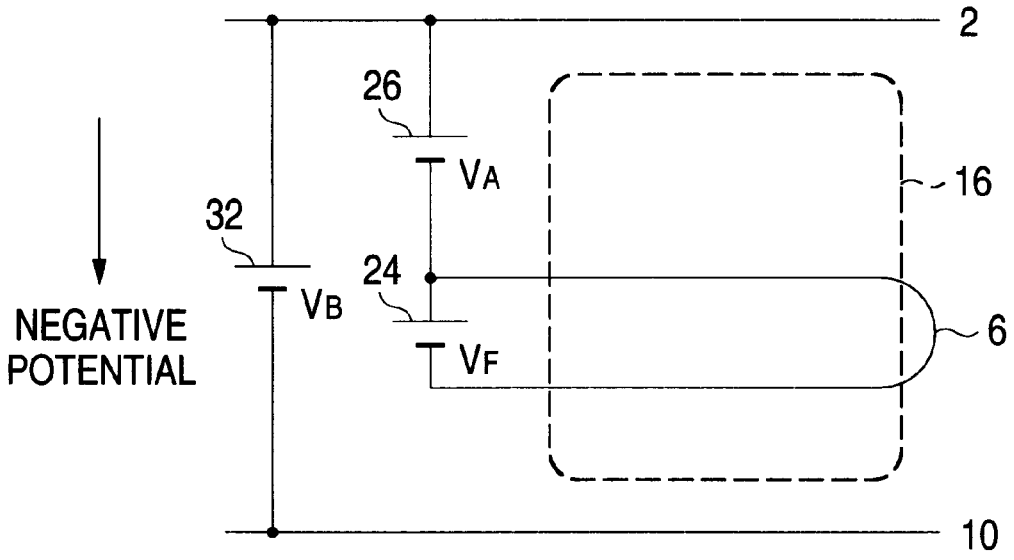
FIG. 11 is a drawing to schematically show an example of potential variation in the ion source in FIG. 10.

FIG. 11 shows an example of potential variation in the ion source of the second embodiment. It maybe considered that two filaments 6 of the same potential and two rear reflectors 10 of the same potential exist.

In the ion source of the second embodiment, the bias voltage $V_B$ as described above is applied from the bias power supply 32 to both the rear reflectors 10, whereby basically a similar advantage to that of the ion source shown in FIG. 1 can be provided.

That is, also with the ion source, if the principal object is to improve the ion production efficiency, the production efficiency of multiply charged and singly charged ions can be enhanced. If the principal object is to prolong the life of the filament 6, the arc voltage $V_A$ can also be reduced for prolonging the life of the filament 6. This can be accomplished in singly charged ion production and multiply charged ion production. Both the ion production efficiency and prolonging the life of the filament 6 can also be improved. To do this, the arc voltage $V_A$ may be reduced less than that if the principal object is to prolong the life of the filament 6.

A similar operation method to that with the ion source shown in FIG. 1 can also be adopted and an advantage as described above can be provided accordingly.

The ion source of the second embodiment shown in FIG. 10 has two pairs of filaments 6 and rear reflectors 10 as compared with the ion source shown in FIG. 1. Thus the ion source has such a feature that the amount of electrons emitted from each filament 6 can be halved for still more prolonging the life of each filament 6.

In the ion source of the second embodiment shown in FIG. 10, most preferably, the bias voltage $V_B$ from the bias power supply 32 is applied to both the reflectors 10; however, the bias voltage $V_B$ may be applied only to either of the rear reflectors 10. In doing so, the energy and the amount of the electrons e reflected on the rear reflector 10 to which the bias voltage $V_B$ is applied can also be increased as described above. Thus the production efficiency of multiply charged or singly charged ions can be improved whereby increasing the ratio of multiply charged or singly charged ions contained in ion beam 18. The arc voltage $V_A$ can also be reduced for prolonging the life of the filament 6.

What is claimed is:

1. An ion source comprising:

a plasma production vessel, into which gas is introduced, serving as a positive potential;

a filament for emitting electrons, disposed in one side of said plasma production vessel and electrically insulated from said plasma production vessel;

an opposed reflector for reflecting electrons, disposed facing said filament in an opposite side of said plasma production vessel and electrically insulated from said plasma production vessel;

a rear reflector for reflecting electrons, disposed facing said opposed reflector in said plasma production vessel while sandwiched between said filament and the one side of said plasma production vessel, said rear reflector being electrically insulated from said plasma production vessel and said filament;

a magnetic field generator for generating a magnetic field along an axis connecting said filament and said opposed reflector in said plasma production vessel;

a filament power supply for heating said filament for emitting electrons;

a DC arc power supply for applying a DC arc voltage between said filament and said plasma production vessel with the filament side as a negative potential for producing arc discharge between said filament and said plasma production vessel; and a DC bias power supply for applying a DC bias voltage between at least one of said opposed reflector and said rear reflector and said plasma production vessel with the reflector side as a negative potential, said bias power supply being individuated from said filament power supply and said arc power supply.

2. The ion source as claimed in claim 1, wherein at least one of said opposed reflector and said rear reflector is made of a material having a higher thermoelectron radiation current density than tungsten.

3. The ion source as claimed in claim 2, wherein the material having the higher thermoelectron radiation current density than tungsten is one of tantalum, molybdenum, niobium, zirconium, alloy of tungsten and yttrium, alloy of tungsten and zirconium.

4. The ion source as claimed in claim 1, wherein said bias power supply outputs the bias voltage which is set larger than 10 V or more than the arc voltage output from said arc power supply.

5. The ion source as claimed in claim 1, wherein said bias power supply outputs the bias voltage for making the potential of at least one of said opposed reflector and said rear reflector negative below the potential of said filament with the potential of said plasma production vessel as the reference.

6. The ion source as claimed in claim 5, wherein the potential of at least one of said opposed reflector and said rear reflector is negative 10 V or more below the potential of said filament.

7. An ion source operation method of the ion source as claimed in claim 1, said method comprising:

controlling the magnitude of the bias voltage output from said bias power supply for controlling the amount of an ion beam extracted from said ion source.

8. The ion source operation method as claimed in claim 7, wherein said controlling step includes setting the bias voltage for a predetermined value which can make the potential of at least one of said opposed reflector and said rear reflector negative below the potential of said filament with the potential of said plasma production vessel as the reference.

9. The ion source operation method as claimed in claim 7, wherein said controlling step includes setting the bias voltage larger than 10 V or more than the arc voltage.

10. The ion source operation method as claimed in claim 7, further comprising:

flowing the filament current into said filament from said filament power supply at the initial condition of operating said ion source; and then controlling the magnitude of the filament current flowing into said filament from said filament power supply to be smaller than that of the initial condition of the operating said ion source.

11. An ion source comprising:

a plasma production vessel, into which gas is introduced, serving as a positive potential;

first and second filaments for emitting electrons, disposed facing each other in said plasma production vessel and electrically insulated from said plasma production vessel;

first and second rear reflectors for reflecting electrons, disposed facing each other while sandwiching said first and second filaments therebetween, said first and second rear reflectors being electrically insulated from said plasma production vessel and said first and second filaments;

a magnetic field generator for generating a magnetic field along an axis connecting said first and second filaments in said plasma production vessel;

a filament power supply for heating said first and second filaments for emitting electrons;

a DC arc power supply for applying a DC arc voltage between said first and second filaments and said plasma production vessel with both filament sides as negative potential for producing arc discharge between both said filaments and said plasma production vessel; and a DC bias power supply for applying a DC bias voltage between at least one of said first and second rear reflectors and said plasma production vessel with the reflector side as a negative potential, said bias power supply being individuated from said filament power supply and said arc power supply.

12. The ion source as claimed in claim 11, wherein at least one of said first and second rear reflectors is made of the material having a higher thermoelectron radiation current density than tungsten.

13. The ion source as claimed in claim 12, wherein the material having the higher thermoelectron radiation current density than tungsten is one of tantalum, molybdenum, niobium, zirconium, alloy of tungsten and yttrium, alloy of tungsten and zirconium.

14. The ion source as claimed in claim 11, wherein said bias power supply outputs the bias voltage for making the potential of at least one of said first and second rear reflectors negative below the potentials of said first and second filaments with the potential of said plasma production vessel as the reference.

15. The ion source as claimed in claim 14, wherein the potential of at least one of said first and second rear reflectors is made negative 10 V or more below the potentials of said first and second filaments.

16. The ion source as claimed in claim 11, wherein said bias power supply outputs the bias voltage which is set larger than 10 V or more than the arc voltage output from said arc power supply.

17. An ion source operation method of the ion source as claimed in claim 11, said method comprising:

controlling the magnitude of the bias voltage output from said bias power supply for controlling the amount of an ion beam extracted from said ion source.

18. The ion source operation method as claimed in claim 17, wherein said controlling step includes setting the bias voltage for a predetermined value which can make the potential of at least one of said first and second rear reflectors negative below the potentials of said first and second filaments with the potential of said plasma production vessel as the reference based on the bias voltage.

19. The ion source operation method as claimed in claim 17, wherein said controlling step includes setting the bias voltage larger than 10 V or more than the arc voltage.

20. The ion source operation method as claimed in claim 17, further comprising:

flowing the filament current into said filament from said filament power supply at the initial condition of operating said ion source; and then controlling the magnitude of the filament current flowing into said filament from said filament power supply to be smaller than that of the initial condition of the operating said ion source.

* * * * *